US007895699B2

(12) United States Patent
Hutchins

(10) Patent No.: US 7,895,699 B2
(45) Date of Patent: Mar. 1, 2011

(54) MOP HEAD INCLUDING CONTOURED TUBULAR FLUID RETAINING STRAND ELEMENTS

(75) Inventor: Walter Monroe Hutchins, Spartanburg, SC (US)

(73) Assignee: Contec, Inc., Spartanburg, SC (US)

( * ) Notice: Subject to any disclaimer, the term of this patent is extended or adjusted under 35 U.S.C. 154(b) by 0 days.

(21) Appl. No.: 12/144,026

(22) Filed: Jun. 23, 2008

(65) Prior Publication Data

US 2008/0253826 A1 Oct. 16, 2008

Related U.S. Application Data

(63) Continuation of application No. 10/865,214, filed on Jun. 10, 2004, now Pat. No. 7,389,559.

(51) Int. Cl.
*A47L 13/20* (2006.01)

(52) U.S. Cl. ..... 15/228; 15/229.1; 428/398; 442/194

(58) Field of Classification Search ..... 15/228, 15/229.1; 428/397–398; 442/189, 194; 138/121, 138/123
See application file for complete search history.

(56) References Cited

U.S. PATENT DOCUMENTS

| | | | | |
|---|---|---|---|---|
| 4,750,234 | A | 6/1988 | Quearry et al. | |
| 4,995,133 | A | 2/1991 | Newell | |
| 5,027,468 | A | 7/1991 | Leventhal et al. | |
| 5,319,807 | A * | 6/1994 | Brier | 2/239 |
| 5,678,278 | A | 10/1997 | McBride et al. | |
| 5,996,164 | A * | 12/1999 | Demetriades | 15/229.1 |
| 6,131,233 | A * | 10/2000 | Bolton et al. | 15/229.1 |
| 6,500,289 | B2 * | 12/2002 | Merker et al. | 156/183 |
| 6,740,401 | B1 * | 5/2004 | Yahata et al. | 428/364 |
| 2001/0000545 | A1 | 5/2001 | Weichelt et al. | |
| 2005/0055791 | A1 | 3/2005 | Lin | |

FOREIGN PATENT DOCUMENTS

JP 02135234 A * 5/1990

* cited by examiner

*Primary Examiner*—Shay L Karls
(74) *Attorney, Agent, or Firm*—J.M. Robertson, LLC

(57) ABSTRACT

An edgeless mop utilizing a relatively narrow diameter, knit tubular material to form the strands of a mop head wherein the tubular material incorporates an arrangement of elongate depressed channels and raised profile segments extending along its surface in the length direction. This construction increases the overall fluid retaining or sorbency capacity of the mop even while lowering the overall mass of the mop head.

5 Claims, 3 Drawing Sheets

MOP HEAD INCLUDING CONTOURED TUBULAR FLUID RETAINING STRAND ELEMENTS

This application is a continuation of copending application Ser. No. 10/865,214 in the name of Walter Monroe Hutchins filed Jun. 10, 2004, the contents of which are hereby incorporated by reference as if fully set forth herein.

TECHNICAL FIELD

The present invention relates generally to fluid retaining mop structures, and more particularly to a mop head incorporating fluid retaining strand elements of contoured, tubular construction incorporating an arrangement of elongate surface channel depressions extending at least partially along the length of such strand elements interposed between raised profile protrusions. A process for forming the mop head is also provided.

BACKGROUND OF THE INVENTION

Mop heads incorporating tubular strand elements of so-called "edgeless" construction are known. One such construction, which is marketed by Contec Inc. of Spartanburg, S.C., is formed from a skein of circular knit material of tubular construction which is formed on a winding apparatus using a pair of support bars which rotate relative to one another. The skein structure is formed from a single continuous tube of the knit material. Upon removal from the winding apparatus, the skein thus has an interior and two ends formed by the reverse folds in the knit tube where it has been passed around the winder bars. The skein structure is thereafter inserted into a relatively narrow width containment sleeve which is seamed to the interior of the skein structure at a substantially central location to contain the tubular elements in the wound structure. Seams are also applied at slightly inboard positions relative to the folded over ends of the skein structure so as to avoid undue spreading of the individual folded over elements. The mop head so formed is thereafter attached to a handle at the central containment sleeve. Importantly, the prior mop heads formed in this manner have utilized a circular knit, tubular structure in the material forming the skein having a substantially uniform flat exterior surface.

SUMMARY OF THE INVENTION

The present invention provides advantages and alternatives over the prior art by utilizing a relatively narrow diameter, knit tubular material to form the strands of a mop head substantially in the same manner as described above but wherein the tubular material incorporates an arrangement of elongate depressed channels and raised profile segments or ridges extending along its surface in the length direction rather than using the flat surface structure of the prior constructions. This construction has surprisingly been found to increase the overall fluid retaining or sorbency capacity of the mop relative to the prior flat surface construction even while lowering the overall mass of the mop head. That is, more fluid may be retained even though less fluid retaining material is utilized thus providing a substantial improvement over the prior known construction.

BRIEF DESCRIPTION OF THE DRAWINGS

The accompanying drawings which are incorporated in and which constitute a part of this specification illustrate potentially preferred embodiments and practices in accordance with the present invention and, together the general description of the invention given above and the detailed description set form below, serve to explain the principles of the invention wherein.

While the invention has been illustrated and generally described above and will hereinafter be described in connection with certain potentially preferred embodiments and procedures, it is to be understood that in no event is the invention to be limited to such illustrated and described embodiments and procedures. On the contrary, it is intended that the present invention shall extend to all alternatives and modifications as may embrace the broad principles of this invention within the true spirit and scope thereof.

DESCRIPTION OF THE PREFERRED EMBODIMENT

Figure 1:
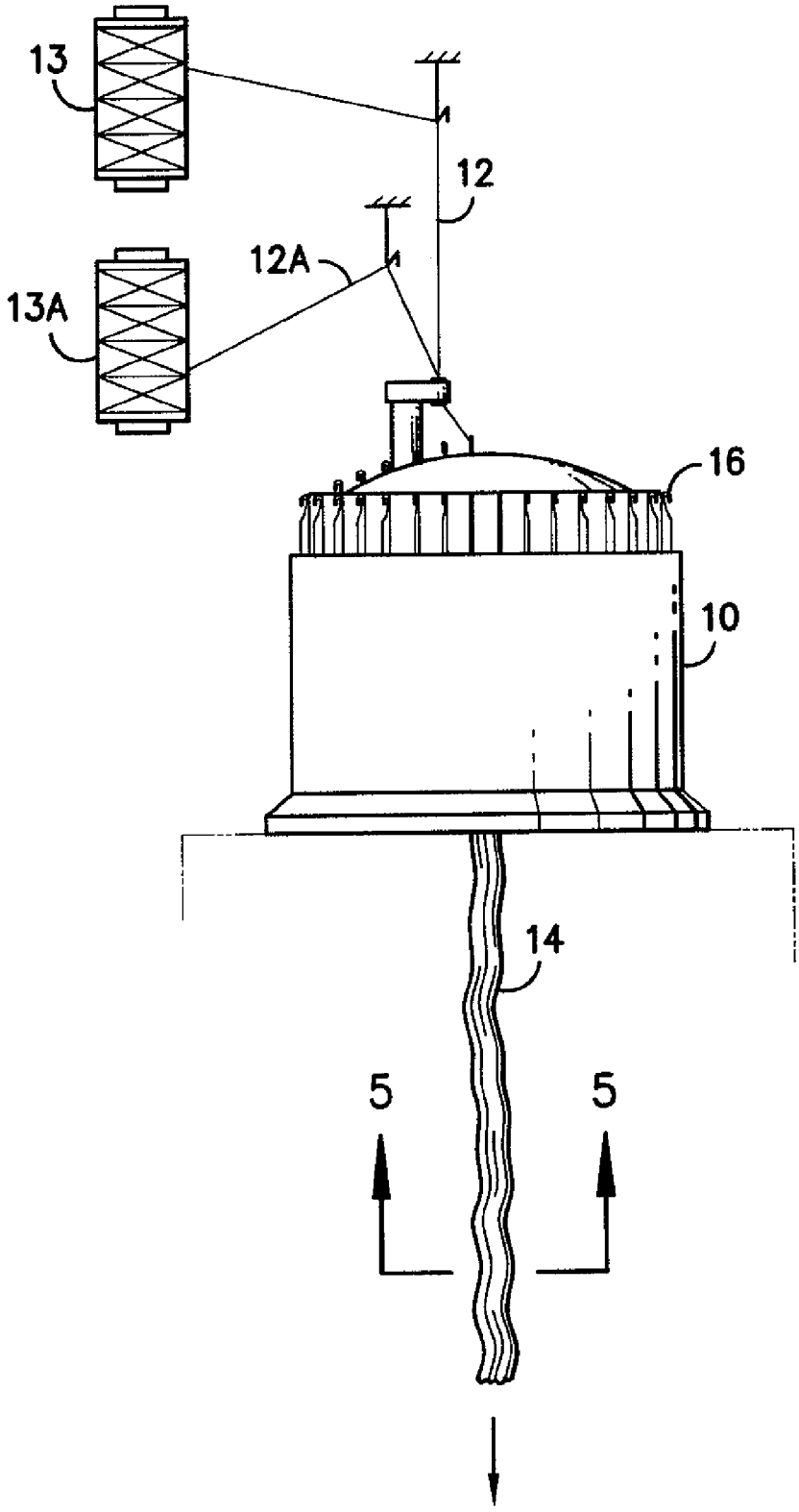
FIG. 1 is a simplified illustration of a circular knitting machine as will be well known to those of skill in the art for use in forming the absorptive string elements of a mop head according to the present invention.

Reference will now be made to the various drawings wherein to the extent possible, like reference numerals are utilized to designate like components throughout the various views. In FIG. 1, there is illustrated a circular knitting machine 10 such as will be well known to those of skill in the art. By way of example only, and not limitation, one knitting machine 10 which has been identified as suitable for practice of the present invention is a model ST3AH/ZA high speed, single feed, circular knit machine having a cylinder size of 1.5 inches in diameter and 48 needle slots available manufactured by Lamb Knitting Machine Corporation having a place of business in Chicopee, Mass. USA.

According to one contemplated practice, in operation a pair of yarns 12, 12A is delivered from spools 13, 13A to the knitting machine 10 for formation of a tubular knit structure 14. The yarn 12 is preferably a 150 denier singles textured polyester having either an "S" or "Z" twist construction. The yarn 12A is preferably a 150 denier two ply textured polyester wherein one ply has an "S" twist and the other ply has a "Z" twist. Thus, the two yarn system incorporates yarn orientations with a combination of opposing twists. This balance in twist permits the knit structure to avoid undue curling when subjected to laundering operations. Of course, the particular yarn system selected may be varied as desired by the user.

Figure 5:
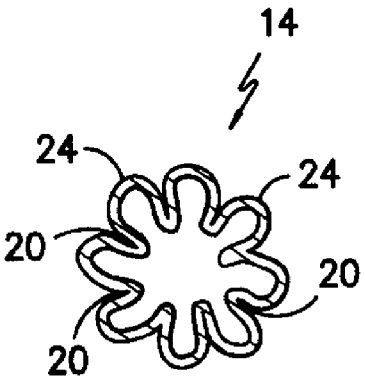
FIG. 5 illustrates an exemplary cross-section of an individual strand taken through line 5-5 in FIG. 1.

The tubular knit structure 14 which is formed according to the potentially preferred practice of the invention includes an arrangement of elongate channel depressions 20 running along the length of the tubular knit structure 14 (FIG. 5). The depressions 20 are disposed between raised profile surface protrusions 24 across the surface of the tubular knit structure 14 such that an undulating or corrugated surface profile is provided wherein the elongate channels and surface protrusions extend in alternating substantially parallel relation.

According to a potentially preferred practice, the illustrated arrangement of channel depressions 20 and raised profile protrusions 24 is achieved by using a modified needle arrangement in the knitting equipment to create a space between courses formed during the knitting process. According to one exemplary practice, the circular knit machine as described above is modified to incorporate a needle arrangement with four needles in and two needles out in an arrangement which is repeated eight times around the circumference of the cylinder. This produces a profiled surface with eight cooperating channel depressions 20 and eight raised profile protrusions 24. Of course this number may be greater or lower as desired but will preferably be at least four and will more preferably be about 6 or greater. According to one potentially preferred practice the machinery is set up to produce a tubular knit structure with fourteen courses per inch (relaxed state) and a weight of about 6.1 grams per linear yard (relaxed state). The resulting construction is a modified jersey knit utilizing thirty-two active needles for knitting.

Figure 2:
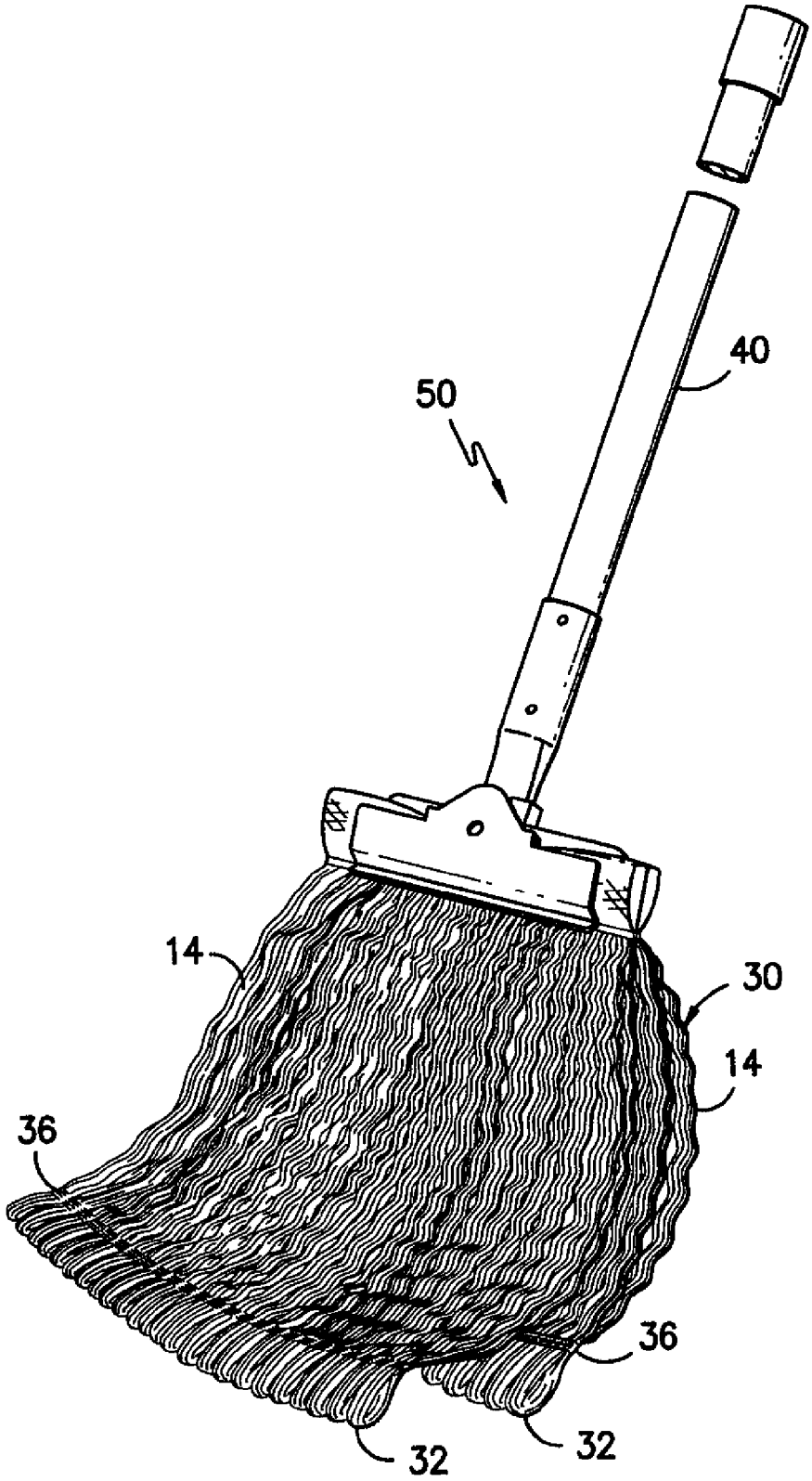
FIG. 2 illustrates a mop head according to the present invention in attached relation to a handle structure.
Figure 3:
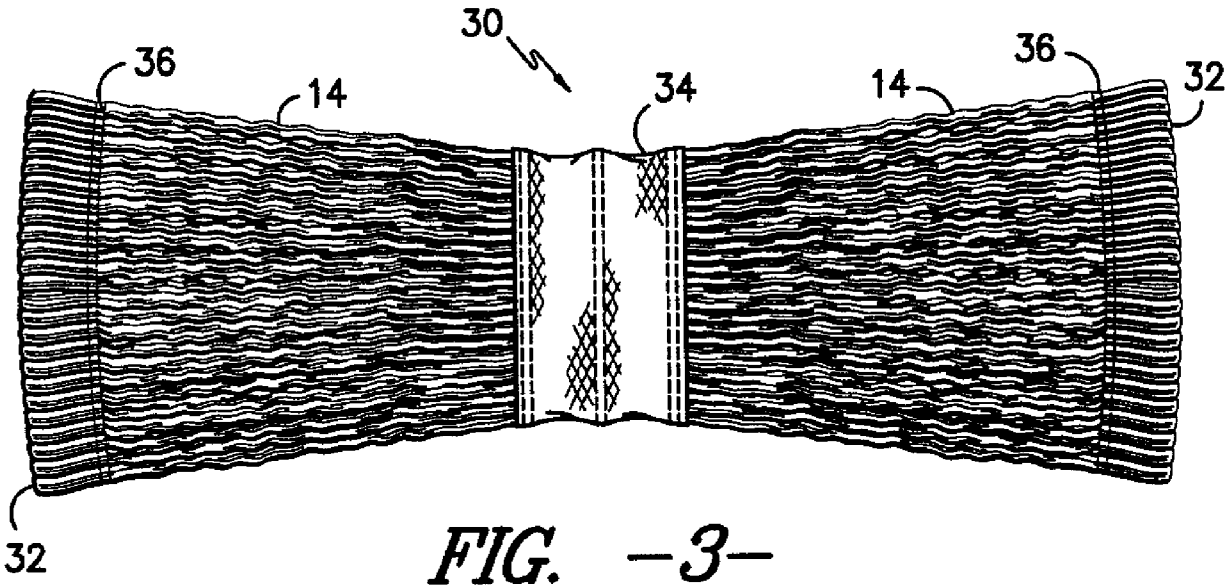
FIG. 3 is an elevation plan view of the mop head in FIG. 2.
Figure 4:
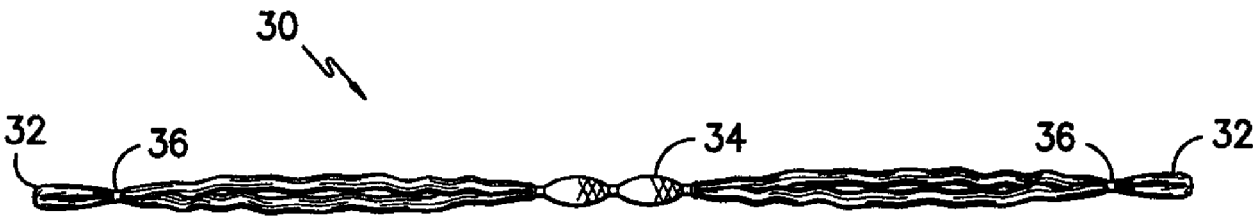
FIG. 4 is a cross-sectional side view of the mop head in FIG. 3.

It is contemplated that the tubular knit structure as described will form the fluid retaining strands of a mop head 30 attached to a handle 40 to form a mop 50 as illustrated in FIG. 2. As best illustrated through simultaneous reference to FIGS. 2-4, the mop head 30 is formed from a skein of the tubular knit material 14. As previously indicated, such a structure may be formed by winding an extended length of the tubular knit material multiple times around a pair of spaced-apart bars and then removing the formed structure from those spaced-apart bars. As illustrated, the resultant skein structure has an arrangement of folds 32 at either end of the skein structure. As will be appreciated, the folds 32 are formed at the location where the tubular knit material is wrapped around the opposing bars during the winding operation. Of course, it is also contemplated that a similar structure may be formed by hand coiling or other techniques as may be desired. Moreover, while it may be desirable to use a single long piece of tubular knit material 14 folded upon itself multiple times to form the mop head, it is also contemplated that two or more shorter lengths may be used if desired. Thus, it is to be understood that by the term "skein" is meant any structure in which one or more lengths of elongate material are folded upon themselves such that the folds define an edge boundary with discrete strand elements extending away from the edge boundary.

According to the illustrated and potentially preferred practice, the skein structure forming the mop head 30 is fitted into a containment sleeve element 34 of fabric or the like which is then seamed in place so as to hold the strands of tubular knit material 14 in adjacent relation to one another at a central location. Moreover, the ends of the tubular knit material where the winding begins and concludes are also held in hidden relation beneath the containment sleeve element 34. Finally, strips of material 36 are seamed in transverse relation to the strands of tubular knit material 14 at positions inboard of the folds 32 so as to maintain a desired adjacent relation of the strand elements at each end of the mop head 30. The mop head 30 may thereafter be washed and dried prior to attachment to the handle 40.

As previously indicated, the adjustment of the circular knitting machine 10 to produce the tubular knit material 14 with interspersed elongate channel depressions 20 and raised profile protrusions 24 yields substantially improved moisture retention capacity even when lower weights of material are utilized. This moisture retention capacity is referred to as "sorbent capacity" and may be made up of moisture retention resulting from absorption and/or adsorption at the strands of tubular knit material. In this regard, it is contemplated that the benefits of the present invention will be applicable to both hydrophilic as well as hydrophobic materials of construction although polyester which is hydrophobic may be particularly preferred.

In order to evaluate the relative performance of a mop head formed according to the present invention, exemplary mop heads formed with fluid retaining strands having elongate channel depressions and raised profile protrusions were weighed in a dry state and were thereafter immersed in water until fully saturated and then weighed in a wet state once dripping had substantially ceased. The contoured surface mop heads were formed according to the potentially preferred practice as described above on a 1.5 inch diameter circular knitting head with an arrangement of four needles in and two needles out repeated eight times around the circumference. Mop heads of similar construction but incorporating flat surface tubular strands of knit material formed on the same knitting head but with all needles in were tested according to the same procedure. Each of the structures was also tested to measure sorbency in a wet state wherein the wet mop was immersed after wringing excess moisture from the mop head following initial saturation. The results are set forth in Table I below:

TABLE 1

| | Dry mop weight | | Dry mop sorbent capacity | | Wet mop sorbent capacity | | | Wet mop weight | |
|---|---|---|---|---|---|---|---|---|---|
| | In grams | In ounces | Intrinsic (mL/g) | Extrinsic mL/mop | Intrinsic (mL/g) | Extrinsic (mL/mop) | % wringability | In grams | In ounces |
| Flat 1 | 433 | 15.3 | 2.83 | 1225 | 0.92 | 400 | 32.7% | 1258 | 44.4 |
| Flat 2 | 431 | 15.2 | 2.67 | 1150 | 0.93 | 400 | 34.8% | 1181 | 41.7 |
| Averages | 432 | 15.2 | 2.75 | 1188 | 0.93 | 400 | 33.7% | 1220 | 43.0 |
| Contoured 1 | 399 | 14.1 | 4.39 | 1750 | 2.01 | 800 | 45.7% | 1349 | 47.6 |
| Contoured 2 | 399 | 14.1 | 4.26 | 1700 | 2.13 | 850 | 50.0% | 1249 | 44.1 |
| Contoured 3 | 402 | 14.2 | 4.35 | 1750 | 1.99 | 800 | 45.7% | 1352 | 47.7 |
| Contoured 4 | 399 | 14.1 | 4.26 | 1700 | 1.88 | 750 | 44.1% | 1349 | 47.6 |
| Contoured 5 | 400 | 14.1 | 4.25 | 1700 | 2.13 | 850 | 50.0% | 1250 | 44.1 |
| Contoured 6 | 401 | 14.1 | 4.49 | 1800 | 2.12 | 850 | 47.2% | 1351 | 47.7 |
| Contoured 7 | 399 | 14.1 | 4.39 | 1750 | 2.13 | 850 | 48.6% | 1299 | 45.8 |
| Averages | 400 | 14.1 | 4.34 | 1736 | 2.05 | 821 | 47.3% | 1314 | 46.4 |

Flat 1 and 2 are the prior structures and contoured 1-6 are specimens of the present invention.

As can be seen, the mop structure of the present invention exhibited substantially greater intrinsic sorbent capacity in both the wet and dry states relative the prior structure using flat tube fluid containment strands.

While the present invention has been illustrated and described in relation to certain exemplary and potentially preferred embodiments and practices, it is to be understood that such embodiments and practices are illustrative only and that the present invention in no event to be limited thereto.

Rather, it is contemplated the modifications and variations will no doubt occur to those of skill in the art upon reading the above description and/or through practice of the invention. It is therefore contemplated and intended that the present invention shall extend to all such modifications and variations which may incorporate the broad concepts of the present invention within the full spirit and scope thereof.

The invention claimed is:

1. A mop head adapted for attachment to a handle structure, the mop head comprising: at least one elongate tube of knit construction folded upon itself to define a folded border with a plurality of fluid retaining stand elements extending away from the folded border, wherein said at least one elongate tube of knit construction comprises an undulating exterior surface profile comprising a plurality of alternating elongate raised profile regions and elongate depressed channels extending in substantially parallel relation to one another in the length direction of said at least one elongate tube of knit construction, and wherein said at least one elongate tube of knit construction consists essentially of polyester and is characterized by a dry sorbency capacity of not less than about 3.5 milliliters of water per gram, and wherein said at least one elongate tube of knit construction has an intrinsic dry sorbency capacity per gram of fiber which is at least 25% greater than the intrinsic dry sorbency capacity per gram of fiber of an elongate tube of knit construction which consists essentially of polyester and has a flat surface profile.

2. The invention as recited in claim 1, wherein said at least one elongate tube of knit construction consists essentially of polyester and is characterized by a dry sorbency capacity of not less than about 4.0 milliliters of water per gram.

3. The invention as recited in claim 1, wherein said at least one elongate tube of knit construction consists essentially of polyester and is characterized by a wet sorbency capacity after wringing of not less than about 1.5 milliliters of water per gram.

4. The invention as recited in claim 3, wherein said at least one elongate tube of knit construction has a modified jersey knit construction.

5. The invention as recited in claim 3, wherein said at least one elongate tube of knit construction comprises at least eight alternating elongate raised profile regions and eight elongate depressed channels.

* * * * *